United States Patent [19]

Engelhardt

[11] 4,021,876

[45] May 10, 1977

[54] MARKING APPARATUS

[76] Inventor: Bernard H. Engelhardt, 48 Manual Drive, Dollard des Ormeaux, Quebec, Canada

[22] Filed: May 17, 1976

[21] Appl. No.: 687,089

[52] U.S. Cl. ..... 15/3; 33/18 R; 101/41; 118/252; 118/260

[51] Int. Cl.[2] ..... A41H 43/00

[58] Field of Search ..... 15/3; 101/41, 35; 33/18; 118/244, 258–260, 263, 252

[56] References Cited

UNITED STATES PATENTS

| | | | |
|---|---|---|---|
| 2,556,474 | 6/1951 | Hurwitz | 101/35 |
| 3,026,847 | 3/1962 | Anderson, Jr. | 15/3 |

FOREIGN PATENTS OR APPLICATIONS

| | | | |
|---|---|---|---|
| 424,947 | 3/1935 | United Kingdom | 101/41 |

*Primary Examiner*—Edward L. Roberts

*Attorney, Agent, or Firm*—Diller, Brown, Ramik & Wight

[57] ABSTRACT

This invention relates to marking apparatus which is capable of imprinting a complete elongated straight mark on a suitable object or stack of objects without the use of a separate guide means. The apparatus consists of an elongated cylindrical rod which comprises the marking element. The rod is disposed in the legs of a holder which is U shaped in cross section in such a manner that a portion of the side of the rod is disposed within the U and another portion of the side of the rod extends beyond the U. Means are provided for providing ink to the outer surface of the rod, and means are provided for rotating the rod about its longitudinal axis. In operation, the rod is placed up against an object to be marked and the rod is rotated. The rod imprints a pattern with the ink from its surface when it is adjacent the object.

10 Claims, 3 Drawing Figures

MARKING APPARATUS

BACKGROUND OF THE INVENTION

1. Field of the Invention

The invention relates to a marking apparatus. More specifically, the invention relates to an apparatus which can imprint a complete elongated straight mark in one stroke on a suitable object or stack of objects without the use of separate guide means.

2. Description of the Prior Art

In order to imprint an elongated straight line with, for example, a pen or pencil, it is necessary to draw the line by placing the pen or pencil at the starting position of the line and running the pen or pencil over the required extent of the line with the aid of a guide means such as a straight edge. There is no apparatus known to applicant which will imprint a complete line in one stroke and without the use of guide means.

An apparatus which could provide the aforesaid, while having many contemplated uses, would be especially useful in the clothes production process as a marking unit for marking the side edges of stacked layers of cloth. In the production of clothes, the various pieces of a clothing unit (i.e. sleeves, collar, pockets etc.) are cut out of a single layer of cloth by placing a pattern for the piece on the cloth and using the pattern as a guide for cutting. In the mass production of clothes, a plurality of each piece is cut at the same time by stacking a plurality of layers of cloth in a pile and placing the pattern at the top of the pile and using the so placed patterns as guides for cutting.

During the cutting operation, it is quite often necessary to mark the pieces at different places to provide instructions for the sewing operator. When the cloth is closely woven, these marks can be provided by cutting into the stack of cloth to provide a notch in each piece at the appropriate place. Alternatively, the mark can be provided by a heated element placed adjacent the side edge of the stack at the appropriate place. The latter cannot be used with synthetic fabrics since they melt and stick or fuse together and the former cannot be used in loose knit fabrics. In addition, cutting notches leads to spoiled or damaged merchandise if it is not perfectly done.

SUMMARY OF THE INVENTION

It is therefore an object of the invention to provide an apparatus which will provide a complete elongated mark with a single stroke of the operation thereof, in such a way that each individual piece has a small but indentifiable spot thereon.

It is a further object of the invention to provide such an apparatus which does not require separate guide means.

In accordance with the invention, an apparatus for imprinting a complete elongated straight mark in one stroke on a suitable object or stack without the use of separate guide means, comprises an elongated cylindrical rod comprising the marking element and holder means which are substantially U-shaped in cross section. The elongated rod is disposed between the legs of the U defined by the cross section of the holder such that a portion of the side of the elongated rod is disposed within the U and a portion of the side of the elongated rod extends outside of the U. An ink absorbent means is disposed in the U of the holder behind the elongated rod and in contacting engagement therewith, and means are provided for rotating the elongated rod about its longitudinal axis, whereby the rod picks up ink when it is adjacent the ink absorbent means and imprints said elongated mark, having the shape of said elongated rod, on said object or stack of objects when it is adjacent an edge thereof.

Preferably, the elongated rod is mounted on a base substantially perpendicular to said elongated rod, and the means for rotating the elongated rod is disposed in the base.

The means for rotating the elongated rod may comprise a flexible elongated means wrapped around and in frictional engagement with the rod at the base end thereof and handle means, having a bottom end extending through a slot in the base whereby the handle means is free to move to and away from the elongated rod. One end of the flexible elongated means is fastened to the bottom end of the handle means, and the other end of the flexible elongated means is fastened to one end of a spring. The other end of the spring is anchored in the base and the spring is biased to return the handle to a first position. Thus, when the handle is moved against the spring bias from the first position in a first linear direction to a second position, the accompanying movement of the flexible elongated means will cause the elongated rod to rotate in a first rotational direction. And, when the handle is released, the action of the bias of the spring will cause the handle to move in a second linear direction, opposite to the first linear direction, to thereby return the handle to the first position, thereby causing movement of the flexible elongated means which will cause the elongated rod to rotate in a second rotational direction.

The apparatus can further comprise a handle and holder support means disposed perpendicular to the base and having an edge extending along a corresponding edge of the holder, the top end of the handle being pivotably mounted on the support means.

The flexible elongated means can comprise a string or a metal wire.

The ink absorbent means can comprise a felt pad.

BRIEF DESCRIPTION OF THE DRAWINGS

The invention will be better understood by an examination of the following description, together with the accompanying drawings in which.

DETAILED DESCRIPTION OF THE DRAWINGS

Figure 1:
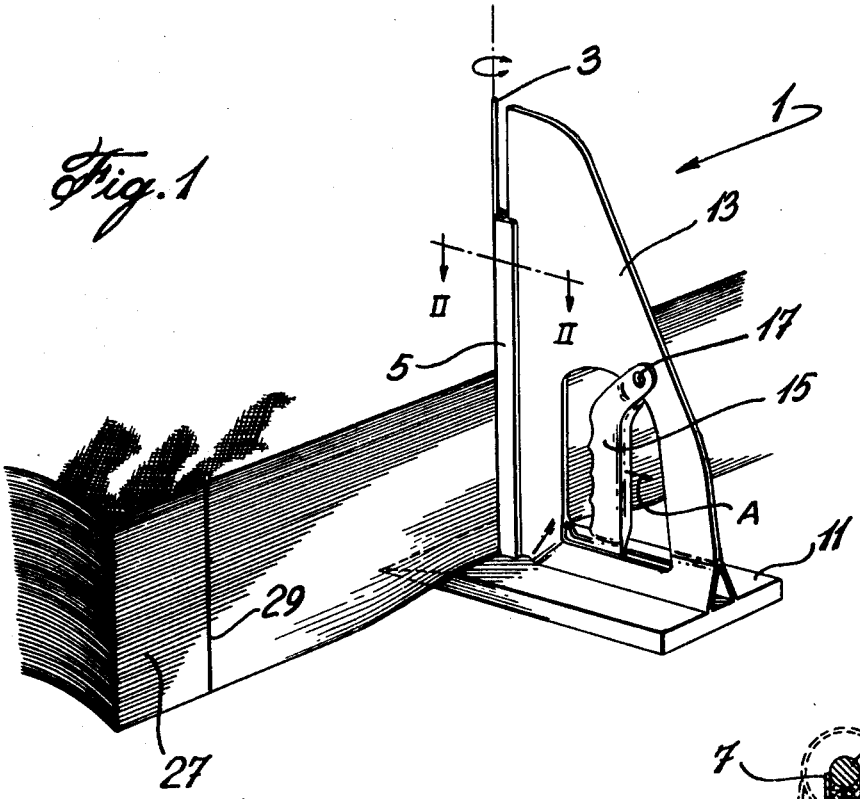
FIG. 1 is a perspective view of an apparatus in accordance with the invention.
Figure 2:
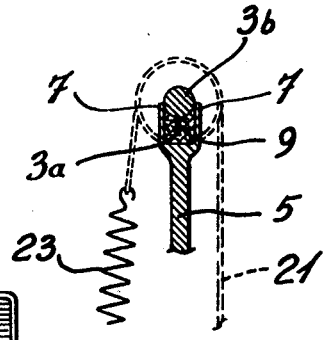
FIG. 2 is a partial cross section through II—II of FIG. 1.

Referring now to FIGS. 1 and 2, the apparatus, designated generally at 1, comprises an elongated cylindrical rod 3, which comprises the marking element of the apparatus, retained in a holder 5. As can be seen in FIG. 2, the holder 5 is U-shaped in cross section, and the rod 3 is disposed between the legs 7 of the U defined by the cross section such that a portion 3*a* of the side of the rod is disposed within the U while a portion 3*b* of the side of the rod extends outside of the U. Ink absorbent means 9, such as a felt pad, is disposed in the U behind the elongated rod, and in contacting engagement therewith, as is seen in FIG. 2.

The rod and holder are mounted on base 11, at right angles to the base, and are supported by support means 13. The support means 13 also supports a handle 15 which is mounted for pivoting about the point 17 on the support means. The base 11 includes a slot 19, shown in FIG. 3, and the bottom end 15*a* of the handle 15 extends through the slot so that the bottom end of the handle is free to move toward and away from the rod in the slot.

A flexible elongated means 21, such as string or metal wire, is fastened at one end thereof to the bottom end 15*a* of the handle, and at the other end thereof to one end of a spring 23. The other end of the spring is anchored in the base at 24. As can be seen, the spring is biased to return the handle to its rest position at the left hand end of the slot. The handle is adapted to be moved, against the bias of the spring, to an activated position at the right hand end of the slot.

Figure 3:
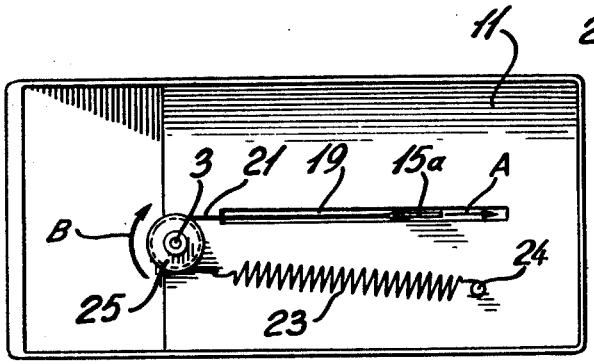
FIG. 3 is a bottom view of the apparatus.

Rod 3 is coaxially and holdingly mounted in wheel 25 which is disposed in the base as seen in FIG. 3, and the flexible elongated means is wrapped around the edge of the wheel and in frictional engagement therewith. It will be appreciated that the wheel 25 is only one way of providing the frictional engagement between the flexible elongated means and the rod. Thus, the flexible means could be wrapped around the rod per se, or in circumferential slots provided in the rod for this purpose. Rack and pinion gears could also be used.

In operation, the apparatus works as follows:

The apparatus is placed up against the edge of an object, such as a stack of layers of cloth 27. The handle is then moved from its rest position in the linear direction of the arrow A so that the bottom end of the handle will also move in the direction of the arrow A. When the bottom end of the handle moves, the flexible means 21 will move with it, and as the flexible means is in frictional engagement with the wheel 25, the wheel 25 will rotate in the rotational direction of arrow B, so that rod 3, holdingly mounted in the wheel, will rotate in the same rotational direction. The spring is pulled into a stretched position as it follows the spring or wire.

The portion 3*a* of the rod will pick up ink when it is adjacent the ink pad, and will imprint the ink on the edge of the stack when it is in the position 3*b*, so that, as rod 3 rotates, it picks up ink and imprints it onto the edge of the stack. When the handle is released, the stretched spring will contract and pull the handle back to its rest position. During the return motion of the handle, the rod will be rotated in a rotational direction opposite to the arrow B, and the imprinting will continue during this time.

Thus, in a single stroke of the apparatus, which is initiated by the action of pulling and releasing the handle, a complete elongated mark, such as 29 in FIG. 1, is imprinted on the object without the use of a separate guide means. As can be seen, the mark 29 has the same shape as the elongated rod.

Although a cylindrical rod and absorbent pad arrangement has been above discussed, it will be apparent that this arrangement could be replaced by an ink impregnated rod. As is known, there are rubber stamps which do not have to be used in association with ink pads. Rather, these stamps are made of ink impregnated rubber. This rubber retains the ink and dispenses it only when the stamp is used.

If the rod is an ink impregnated rod, then the rod will either be covered with or made of ink impregnated rubber, or a like material. With this arrangement, there is no longer any requirement for the ink absorbent means.

Although a single embodiment has been illustrated, this was for the purpose of describing, but not limiting, the invention. Various modifications, which will come readily to the mind of one skilled in the art, are within the scope of the invention as defined in the appended claims.

I claim:

1. An apparatus for imprinting a complete elongated straight mark in one stroke on a suitable object or stack of objects without the use of separate guide means, said apparatus comprising:
   - an elongated cylindrical rod comprising the marking element;
   - holder means being substantially U-shaped in cross section, said elongated rod being disposed between the legs of the U defined by the cross section of the holder such that a portion of the side of the elongated rod is disposed within the U and a portion of the side of the elongated rod extends outside of the U;
   - means for providing ink to the outer surface of said rod; and
   - means for rotating said elongated rod about its longitudinal axis;
   - whereby the rod imprints said elongated mark, having the shape of said elongated rod, on said object or stack of objects when it is adjacent an edge thereof with the ink on its outer surface.

2. An apparatus as defined in claim 1 wherein said elongated rod is mounted on a base substantially perpendicular to said elongated rod, and wherein said means for rotating said elongated rod is disposed in said base.

3. An apparatus as defined in claim 2 wherein said means for rotating said elongated rod comprises:
   - a flexible elongated means wrapped around and in frictional engagement with said rod at the base end thereof;
   - handle means, having a bottom end extending through a slot in said base whereby said handle means is free to move to and away from said elongated rod;
   - one end of said flexible elongated means being fastened to said bottom end of said handle means;
   - the other end of said flexible elongated means being fastened to one end of a spring;
   - the other end of said spring being anchored in said base;
   - said spring being biased to return said handle to a rest position;
   - whereby, when said handle is moved against the spring bias from said rest position in a first linear direction to an activated position, the accompanying movement of said flexible elongated means will cause said elongated rod to rotate in a first rotational direction, and, when said handle is released, the action of the bias of said spring will cause the handle to move in a second linear direction, opposite to said first linear direction, to thereby return said handle to said rest position, thereby causing movement of said flexible elongated means which will cause said elongated rod to rotate in a second rotational direction.

4. An apparatus as defined in claim 3 and further comprising handle and holder support means disposed perpendicular to said base and having an edge extending along a corresponding edge of said holder;

the top end of said handle being pivotably mounted on said support means.

5. An apparatus as defined in claim 4 wherein said flexible elongated means comprises a metal wire.

6. An apparatus as defined in claim 4 wherein said flexible elongated means comprises a string.

7. An apparatus as defined in claim 1 wherein said rod comprises an ink impregnated material.

8. An apparatus as defined in claim 1 wherein said means for providing ink to the surface of said rod comprises an absorbent means in the U of said holder behind said elongated rod and in contacting engagement therewith;

whereby, said rod picks up ink when it is rotated about its longitudinal axis.

9. An apparatus as defined in claim 8 wherein said ink absorbent means comprises an absorbent pad.

10. An apparatus as defined in claim 9 wherein said absorbent pad comprises a felt pad.

* * * * *